US009015894B2

(12) United States Patent
Abraham

(10) Patent No.: US 9,015,894 B2
(45) Date of Patent: Apr. 28, 2015

(54) EXTENDABLE APPLICATION DEVICE

(75) Inventor: David Abraham, Westerville, OH (US)

(73) Assignee: TaDa Investments LLC, Lewis Center, OH (US)

( * ) Notice: Subject to any disclaimer, the term of this patent is extended or adjusted under 35 U.S.C. 154(b) by 283 days.

(21) Appl. No.: 12/476,919

(22) Filed: Jun. 2, 2009

(65) Prior Publication Data

US 2010/0299860 A1 Dec. 2, 2010

(51) Int. Cl.
*A47K 7/02* (2006.01)

(52) U.S. Cl.
CPC ..... *A47K 7/02* (2013.01)

(58) Field of Classification Search
USPC ..... 15/222, 229.11, 229.12, 229.13, 210.1, 15/209.1
See application file for complete search history.

(56) References Cited

U.S. PATENT DOCUMENTS

| | | | | |
|---|---|---|---|---|
| 2,093,110 | A | 9/1937 | Meleady | |
| 4,422,205 | A | 12/1983 | Braxter | |
| 4,672,707 | A | 6/1987 | Johnson | |
| 5,144,744 | A | 9/1992 | Campagnoli | |
| 5,555,591 | A | 9/1996 | Chang | |
| 5,727,278 | A | 3/1998 | Per-Lee | |
| 5,736,213 | A * | 4/1998 | Meier | 428/76 |
| 5,766,700 | A * | 6/1998 | Borcherds | 428/5 |
| 5,784,747 | A | 7/1998 | Girardot et al. | |
| 5,944,032 | A | 8/1999 | Masterson | |
| 6,015,242 | A | 1/2000 | Gillis | |
| 6,048,407 | A | 4/2000 | Schoch | |
| 6,098,236 | A * | 8/2000 | Chen | 15/222 |
| 6,131,780 | A * | 10/2000 | Becker | 224/148.6 |
| 6,227,742 | B1 | 5/2001 | Corn | |
| 6,276,022 | B1 | 8/2001 | Gallacher | |
| 6,786,666 | B1 * | 9/2004 | Floyd-Williams et al. | 401/118 |
| 6,871,375 | B2 | 3/2005 | Borcherds | |
| 6,957,924 | B1 | 10/2005 | McMeekin et al. | |
| 2002/0197097 | A1 * | 12/2002 | Rabbani | 401/201 |
| 2003/0208871 | A1 | 11/2003 | Osborne | |
| 2009/0013486 | A1 * | 1/2009 | Dow | 15/143.1 |
| 2009/0255080 | A1 * | 10/2009 | Lozinik | 15/229.13 |

* cited by examiner

*Primary Examiner* — Robert Scruggs
(74) *Attorney, Agent, or Firm* — Standley Law Group LLP

(57) ABSTRACT

An extendable applicator device which allows a user to apply soap, lotion, medication, or various other substances to areas of the body which may be difficult to reach. The device can function as a traditional scrubbing or application device but may also be extended so that the user's back, shoulders, or other areas can be addressed as well. Exemplary embodiments use an elastic member that can elongate to allow an extended reach. Other embodiments use a locking mechanism or a retracting assembly to allow the device to extend.

12 Claims, 9 Drawing Sheets

EXTENDABLE APPLICATION DEVICE

BACKGROUND OF THE INVENTIVE FIELD

The exemplary embodiments herein relate generally to application devices and more specifically to application devices which can be extended to allow a further reach by the user.

Balls of polymer mesh, commonly referred to as 'shower puffs' have recently become popular for use in personal hygiene. These polymer mesh puffs are typically manufactured from one or more pieces of synthetic open cell mesh which are bound together and manipulated into a plurality of random folds to form a generally rounded shape, or puff. The open cell structure of the mesh advantageously forms a structure which effectively cleans the body, lathers soap, as well as rinses and dries more easily than traditional wash cloths. A string, metallic staple, or plastic strip is often used to bind the pieces of mesh about a center point.

While these devices have enjoyed a certain amount of success, the ability to reach parts of the body is limited by the effective reach of the user. For elderly, larger, injured, or inflexible users, reaching certain parts of the body for effective cleaning with devices of the past can be difficult or impossible. Even for healthy and flexible users, the ability to clean one's back is also difficult or impossible with devices of the past. While there have been devices which increase the effective reach of the user (i.e. back scrubbers), these devices have typically comprised a rigid elongated handle, which can make traveling with the device difficult and can also obstruct an already crowded shower or bath. Further, even if adapted to receive a shower puff, these handles require a specific type of shower puff which may or may not be readily available for the user to purchase.

SUMMARY OF THE GENERAL INVENTIVE CONCEPT

Exemplary embodiments provide a new type of bathing device which is capable of extending so that the user may scrub their back or other hard to reach areas. Some embodiments utilize a scrubbing material which is similar to the open cell mesh material that has been previously used for shower puffs. Other embodiments utilize a scrubbing material which is similar to a loofah, sponge, cloth, fabric, or any combination of the above. An exemplary embodiment provides an elastic band which is surrounded by one or more scrubbing materials and is capable of extending to provide the user with an increased effective reach. Other embodiments may use a retractable cable assembly or cord with a locking mechanism to facilitate the extension of the device. Further, the elongation provides for faster rinsing and drying of the chosen material.

Also, there is a need for a device which allows a user to reach their back to apply lotion, sunscreen, medications, and tanning oil. Specifically, now that sun-less tanning lotions have become popular (due to the risk of cancer from natural sunlight) there is a further need to allow users to apply a consistent amount of these substances on their back and shoulders to maintain a uniform level of hue or tone in their skin. Thus, some embodiments may use a modified scrubbing material to facilitate the application of lotion, sunscreen, medication, tanning oil, or any other substance that a user may want to apply to their own backs or hard to reach areas. A semi-absorbent cloth or similar fabric may be used for this purpose.

The device may also be used in a packaging assembly where the device could encircle several products included in the package. Using the device in this way not only provides pleasing aesthetics, but also provides a means to secure the various products and protect them from damage.

BRIEF DESCRIPTION OF THE DRAWINGS

In addition to the features mentioned above, other aspects of the present invention will be readily apparent from the following descriptions of the drawings and exemplary embodiments, wherein like reference numerals across the several views refer to identical or equivalent features, and wherein.

DETAILED DESCRIPTION OF EXEMPLARY EMBODIMENT(S)

As discussed above, if used for personal hygiene purposes, the various embodiments may contain one or more different scrubbing materials which are commonly used for personal hygiene. Some of the scrubbing materials include: mesh material, loofah/sponge material, cloth/fabric, or any combination of the above. Alternatively, if used to apply lotion, sunscreen, medication, tanning oil, or similar substances, a semi-absorbent cloth or other fabric which is designed to apply these substances may be preferable. For simplicity, the term 'application material' will be used herein to describe the various embodiments but it should be understood that this term includes the scrubbing materials as well as any absorbent cloth or lotion-applying fabric.

A preferable mesh material has a plurality of individual open cells. The structure of each cell, which is defined by both the size and shape of the individual cells, may be widely varied without deviating from the scope of this invention. In an exemplary arrangement, the individual cell shape will take the form of diamond mesh. Preferably, the mesh material is formed from any highly resilient polymer, such as polyethylene or nylon, although it will be understood by one skilled in the art that other polymers, metals, fibrous blends, or similar materials may be suitable. Similarly, the physical properties (e.g., molecular weight, molecular weight distribution, melt index, etc.) of a material used to form the mesh may be varied as desired to achieve the suitable end characteristics (e.g., resiliency, softness, etc.) for its intended use without subtracting from the scope of this invention. A number of different open cell mesh materials are sold as 'shower puffs' and any one may be used with the exemplary embodiments.

Exemplary embodiments use an elastic member which is surrounded by one or more application materials. As used herein, the term 'elastic' refers to a member which is capable of elastic deformation when exposed to tensile forces. Although various rubbers and thermoplastic elastomers may be used with various embodiments, the use of the term 'elastic' does not require any specific material.

Figure 1B:
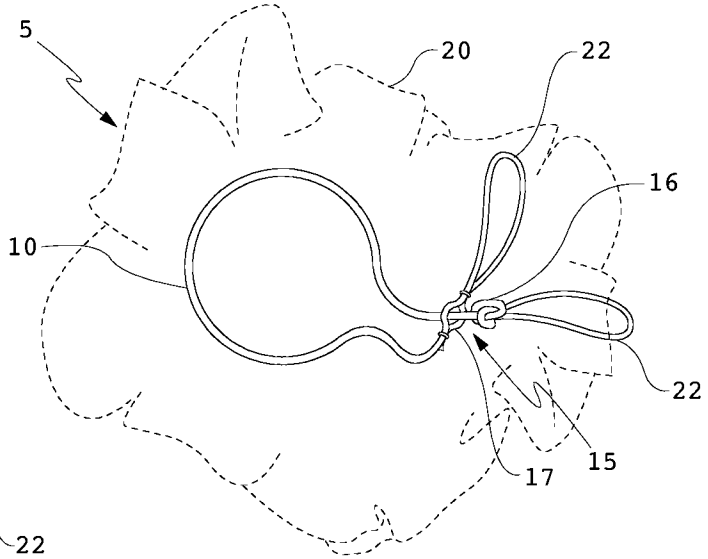
FIG. 1B is a front view of the embodiment from FIG. 1A where an application material is shown as hidden with a detailed view of one type of fastening means for the elastic member.
Figure 1A:
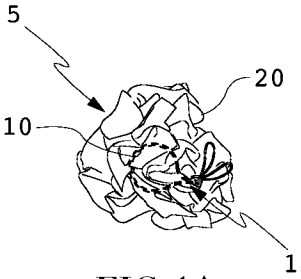
FIG. 1A is a front view of an exemplary embodiment where two ends of an elastic member are fastened.

FIG. 1A shows an exemplary embodiment of an extendable application device 5 which uses an elastic member 10 (shown as a dashed line) surrounded by application material 20. In this figure, the elastic member 10 is fastened so as to form the elastic member 10 into a ring. The ends of the elastic member 10 are fastened together with a fastening means 15. In this orientation, the extendable application device 5 can function similar to a common 'shower puff.'

FIG. 1B provides a similar view as FIG. 1A, except the application material 20 is now shown with hidden lines so that the details of the elastic member 10 and fastening means 15 may be observed. For this embodiment, the fastening means 15 comprises a knot 16 on a first end of the elastic member 10 and a corresponding loop 17 on the second end of the elastic member 10. Obviously, the particular fastening means shown here is not necessary to practice any of the embodiments. Rather, one skilled in the art could use other types of suitable fastening means, including but not limited to: retaining clips, hooks, balls (or other objects), as well as any number of different knots (either pre-tied or tied by the user). Of course, a preferable fastening means should be substantially free of rough edges, protrusions or outwardly extending structures which may tend to cause undesirable tactile consequences (e.g., cutting, slicing, scrapping, abrading or otherwise injuring the user at any sensitive surface) during use.

Also shown in this figure are grips 22 which may be attached to, or formed from, the elastic member 10. The grips 22 make it easier for the user to grasp and extend the elastic member 10 once the device 5 becomes wet and/or lathered with soap/lotion. The grips can take many forms, and may include but are not limited to: loops, balls (or other objects), hooks, handles, and knots.

Figure 1C:
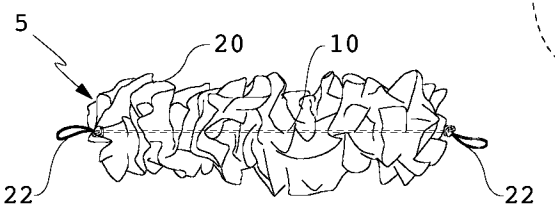
FIG. 1C is a front view of the embodiment from FIGS. 1A and 1B where the elastic member is unfastened.
Figure 1D:
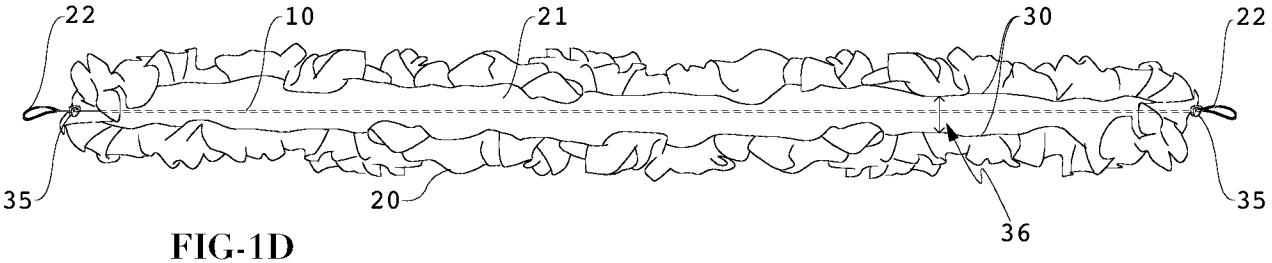
FIG. 1D is front view of the embodiment from FIGS. 1A-1C where the elastic member is extended.

FIG. 1C shows the embodiment from FIGS. 1A and 1B where the elastic member 10 has been unfastened and the device 5 is in a relaxed state (i.e. not extended). FIG. 1D shows the embodiment from FIGS. 1A-1C where the elastic member 10 has been extended. The grips 22 may be utilized by the user in order to extend the elastic member 10. The particular embodiment shown here uses two application materials. The first is the application material 20 that has been discussed in reference to FIGS. 1A-1C above. The second is a center application material 21. The application material 20 is attached along the edges 30 of the center application material 21 which is essentially a tubular structure having a hollow center with two open ends. The open ends of the center application material 21 are attached to the elastic member at attachment points 35 so that the application material 20 and the center application material 21 extend when the elastic member 10 is extended.

The elastic member 10 may be attached to the chosen application material using a number of different attachment methods. An exemplary embodiment would sew or thread the two materials together. Other embodiments may use a binding member to attach the materials. An exemplary binding member is preferably non-abrasive. The term "non-abrasive", as used herein, shall connote a binding member which, in use, is substantially free of rough edges or protrusions which may tend to cause undesirable tactile consequences (e.g., cutting, slicing, scrapping, abrading or otherwise injuring the user at any sensitive surface) during use.

The types of binding members which could be used in some embodiments include: a locking tether with a flexible cord and locking cleat, an interlocking ring (squeeze clamp), elastic polymer ring, break-away tie, and a heat pinched section. These binding members are shown and described in U.S. Pat. No. 5,784,747 to Girardot, herein incorporated by reference in its entirety.

The elastic member 10 travels along the hollow center of the center application material 21. For the embodiment shown in FIG. 1D, the diameter 36 of the center application material 21 is much larger than the diameter of the elastic member 10. Obviously, the relative diameters of these two materials can vary widely. In some embodiments, the center application material 21 may have a diameter that is nearly the same as the diameter of the elastic member 10. The center application material 21 can be any none abrasive material, including any one of the application materials discussed herein.

Obviously, the elastic member 10 and the center application material 21 may not be a perfect hollow cylinder (tube) and may take on different cross sectional geometries. For example, the center application material 21 may have a cross section which resembles a flattened channel (i.e. tube which has been radially compressed) and the elastic member 10 may have a square or rectangular cross section. Thus, although the relative sizing of the two elements has been discussed in reference to their diameters, it should be recognized that diameters may also be interpreted as thicknesses or widths in the case of these alternative geometries.

Figure 2:
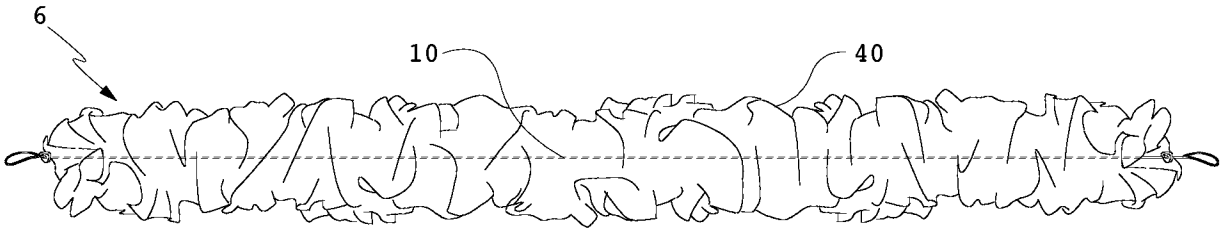
FIG. 2 is a front view of an embodiment which surrounds an elastic member with application material.

FIG. 2 shows another embodiment 6 where the elastic member 10 has been extended. In this embodiment 6, the elastic member 10 is simply surrounded by the application material 40 and does not utilize a center application material. The application material 40 in this embodiment 6 may resemble a flexible hollow tube such that the elastic member 10 may travel along the hollow center of the tube.

Figure 3B:
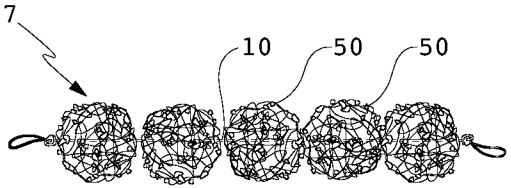
FIG. 3B is a front view of the embodiment from FIG. 3A where the elastic member is unfastened.
Figure 3A:
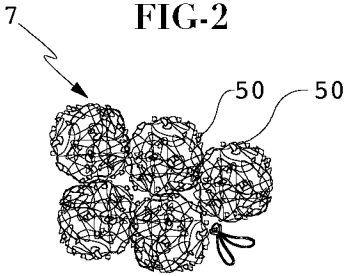
FIG. 3A is a front view of an embodiment where an application material comprises a plurality of localized groupings of material.
Figure 3C:
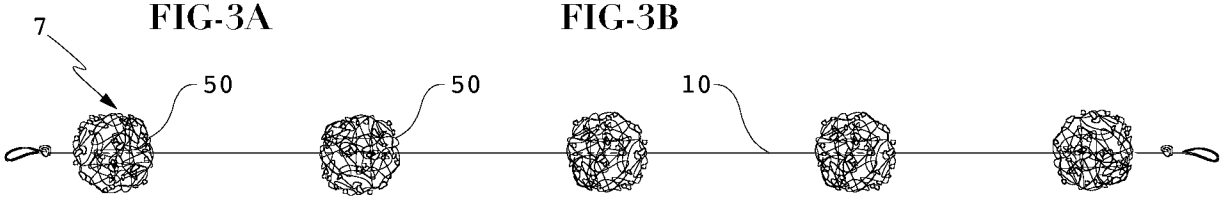
FIG. 3C is front view of the embodiment from FIGS. 3A and 3B where the elastic member is extended.

FIG. 3A shows an embodiment 7 where an application material 50 comprises a plurality of localized groupings rather than a continuous piece of material. This embodiment 7 may be beneficial when using a sponge, loofah, or semi-absorbent cloth as the application material. FIG. 3B shows the embodiment from FIG. 3A where the elastic member 10 has been unfastened and the device 7 is in a relaxed state (i.e. not extended). FIG. 3C shows the embodiments from FIGS. 3A and 3B where the elastic member 10 has been extended.

Figure 4B:
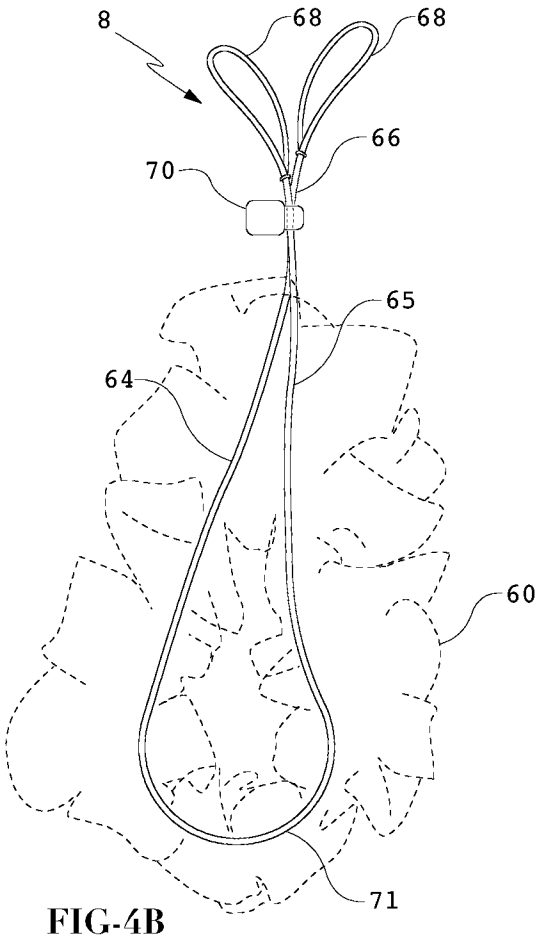
FIG. 4B is a front view of the embodiment from FIG. 4A where the device is in the extended position.
Figure 4A:
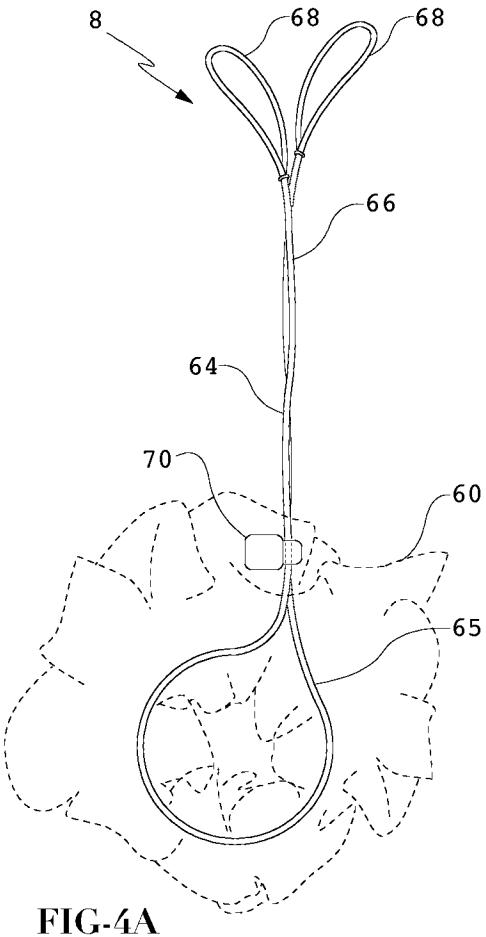
FIG. 4A is a font view of an embodiment where an application material may move along a member and is held in place using a locking mechanism.

FIG. 4A shows an embodiment 8 where the application material 60 is not attached to an elongate member 64, which may or may not be elastic. Although the elongate member 64 is a continuous piece, for clarification purposes, it will be described as two sections. The first section 65 has the application material 60 surrounding it while the second section 66 does not. Also, the second section 66 contains one or more grips 68. A locking mechanism 70 may be used to hold the application material 60 in place when using the device 8 in the non-extended state (as shown in FIG. 4A).

FIG. 4B shows the embodiment from FIG. 4A once it has been extended. As can be readily observed, the locking mechanism 70 has been moved closer to the grips 68 so that the application material 60 may extend along the elongate member 64, thereby causing the length of section 66 to be shortened and the length of section 65 to be lengthened. A user may utilize the loop 71 in the section 65 as a grip when using the device in this extended state. The locking mechanism 70 may be any type of cord, cable, or string restraint that is commonly used in the art. Some examples of the locking mechanism 70 may include a spring-loaded device which naturally places pressure on the member 64 but may be released by the user through an actuation force. Other examples may be a simple piece which has a slight interference fit with the member 64 so that it does not move easily.

Figure 5A:
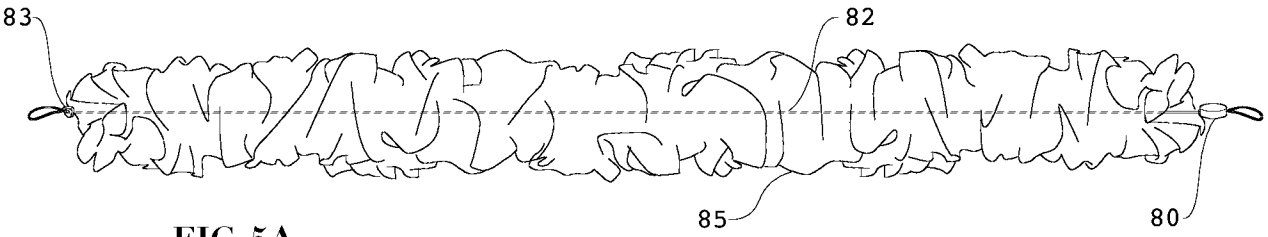
FIG. 5A is a front view of an embodiment which uses a retracting assembly.
Figure 5B:
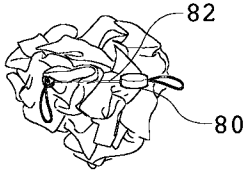
FIG. 5B is a front view of the embodiment from FIG. 5A once the device has been retracted.

FIG. 5A shows an embodiment which uses a retracting assembly 80. The application material 85 may surround an elongate member 82 which may be extended from, or retracted into the retracting assembly 80. In an exemplary embodiment, the elongate member 82 would not be elastic, and may be a small diameter cable or wire. One end 83 of the elongate member 82 may be fastened to (or otherwise have restricted movement with) the application material 85 such that as the end 83 is retracted towards the retracting assembly 80, the application material 85 is axially compressed. FIG. 5B shows the embodiment from FIG. 5A once the elongate member 82 has been retracted into the retracting assembly 80.

Various designs for retracting assemblies are known and many designs would be suitable for use with this embodiment. Typically, retracting assemblies contain a spool within a housing where the spool is under a spring loaded force in order to become biased in a certain rotation direction. A length of cable or wire may be wound around the spool so that a desired length may be removed from the spool and housing for use. In some embodiments, removing the cable from the spool causes the loading of a torsion spring which may then be used to retract the cable back onto the spool after use. These devices are commonly used with tape measures and identification lanyards, as well as for the management of electrical cable and pneumatic hoses.

Figure 6A:
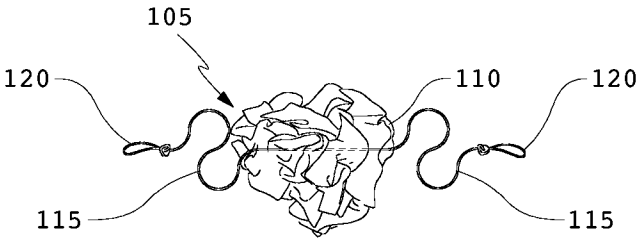
FIG. 6A is a front view of an embodiment which uses a traditional shower puff with elastic members where the device is in a relaxed state.

FIG. 6A shows another embodiment 105 which uses a traditional shower puff 110 with elastic members 115 on opposing sides of the shower puff 110. FIG. 6A shows this embodiment 105 in the relaxed state (i.e. not extended). The term 'traditional shower puff' is used herein to denote a shower puff that is in a fixed 'ball' and not capable of extension.

Figure 6B:
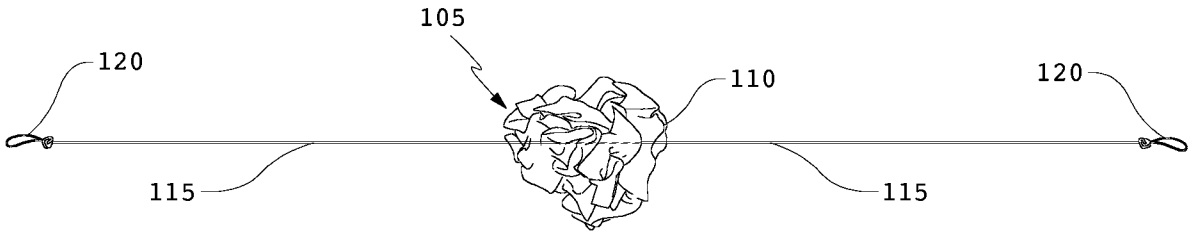
FIG. 6B is a front view of the embodiment from FIG. 6A where the device has been extended.

FIG. 6B shows the embodiment 105 when it has been extended. A pair of grips 120 may be attached to the ends of the elastic members 115 to facilitate the extension of the device 105. The elastic members 115 may comprise a single piece of elastic material that is fastened to the shower puff 110. Alternatively, the elastic members 115 may comprise separate pieces which are attached on opposite sides of the shower puff 110. Other embodiments may use one or more cable retracting assemblies (similar to that shown in FIG. 5A-5B) near the shower puff 110 and adapted to allow a pair of cables to extend outward from the shower puff 110 (and of course retract).

Figure 7:
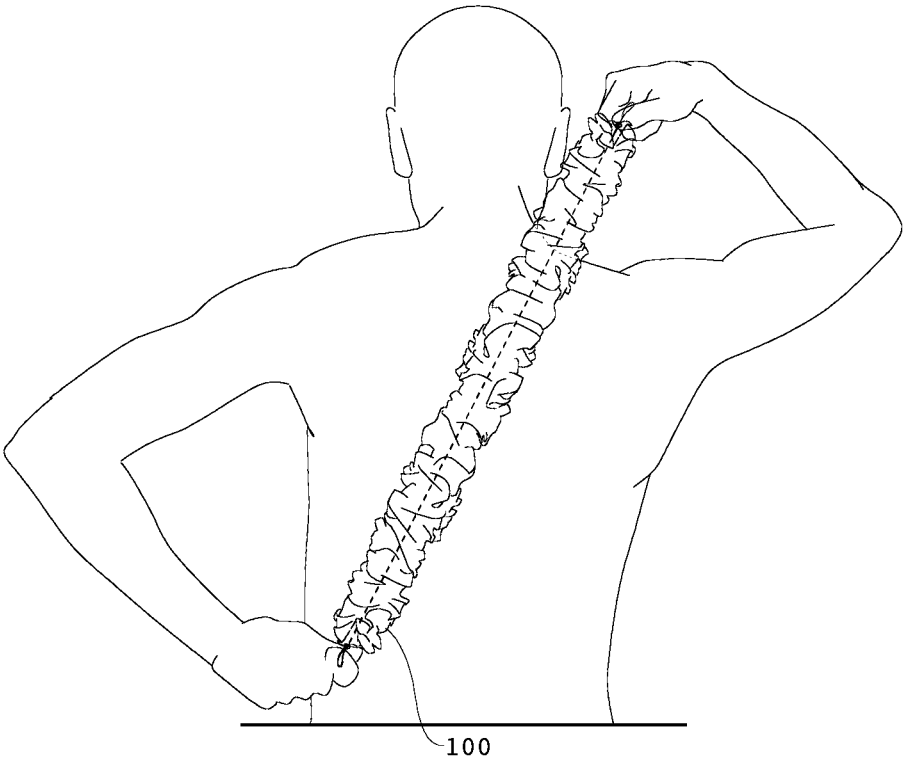
FIG. 7 is an illustration of one exemplary use of a device by a user.

FIG. 7 shows an illustration of one potential use of an exemplary device 100 in an extended state. Thus, embodiments provide the traditional benefits of scrubbing materials such as shower puffs and wash cloths while also allowing the user to use the same device in order to reach their shoulders and back. Also, as discussed above, embodiments can provide an effective reach to the back for applying various other substances to the user's back including but not limited to: lotion, sunscreen, medications, and tanning oil. The device is also beneficial to users who are elderly, larger, injured, or inflexible who may have difficulty reaching other portions of their body in addition to their back and/or shoulders.

The device can be produced in various sized to accommodate different users and their intended use. Further, some devices may be produced which are large enough to be used for the cleaning or waxing of automobiles, boats, and recreational vehicles.

Figure 8:
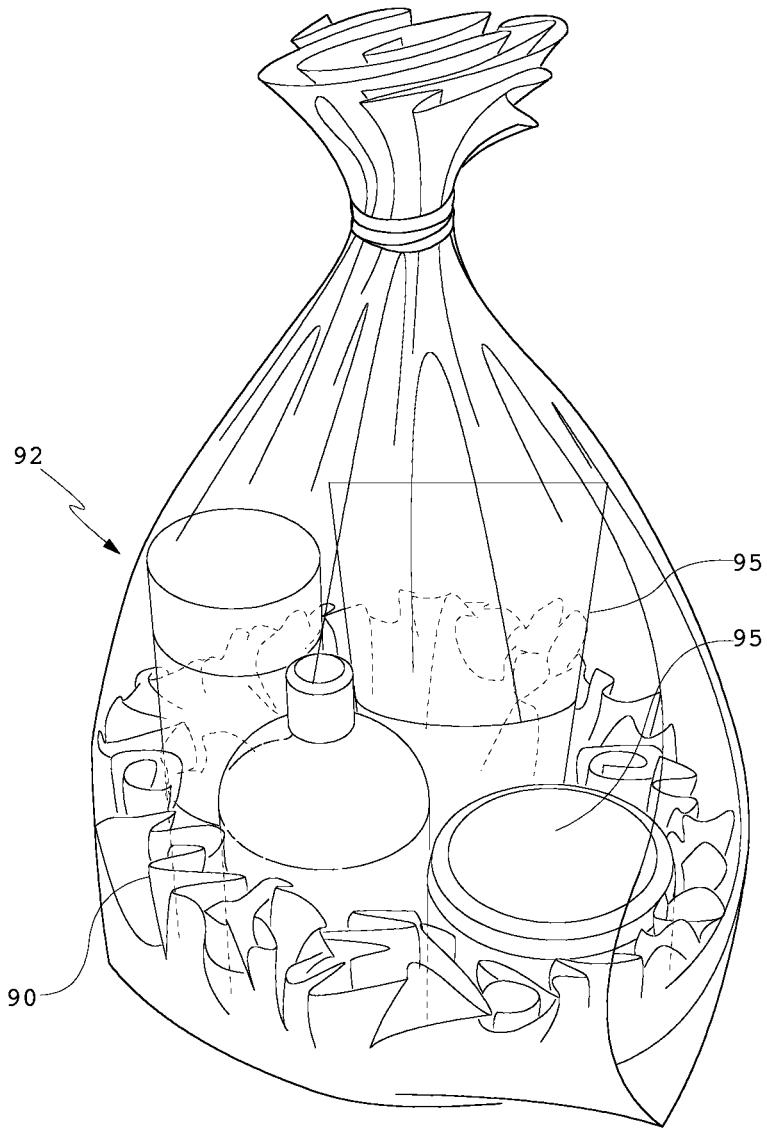
FIG. 8 is an illustration of the use of an exemplary device within a transparent bag packaging assembly.

FIG. 8 shows the use of an exemplary device 90 within a transparent bag packaging assembly 92. The device 90 may be extended around (i.e. encircle) various different products 95 included within the packaging assembly 92. The products 95 may include various bathing/hygiene/moisturizing products, possibly even those that are designed to be used with the device 90. The packaging assembly 92 shown is similar to the common transparent bag gift sets that might be found at some retail establishments. A transparent plastic material is typically used to construct the bag. Exemplary bags may be comprised of cellophane material.

Figure 9:
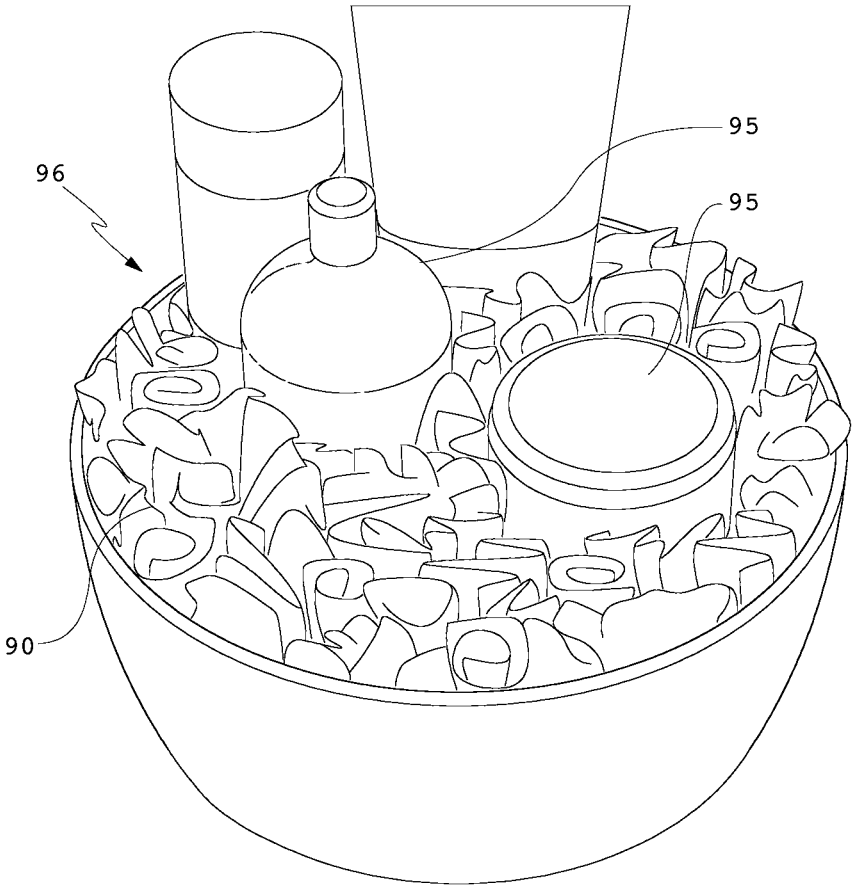
FIG. 9 is an illustration of the use of an exemplary device within a container packaging assembly where the device is placed between products.

FIG. 9 shows the use of an exemplary device 90 within a container packaging assembly 96. In this embodiment, the device 90 may pass between products 95. The container may be any type of open-top container. In an exemplary embodiment, the container would be a basket which is similar to the common gift basket sets that might be found at some retail establishments.

Figure 10:
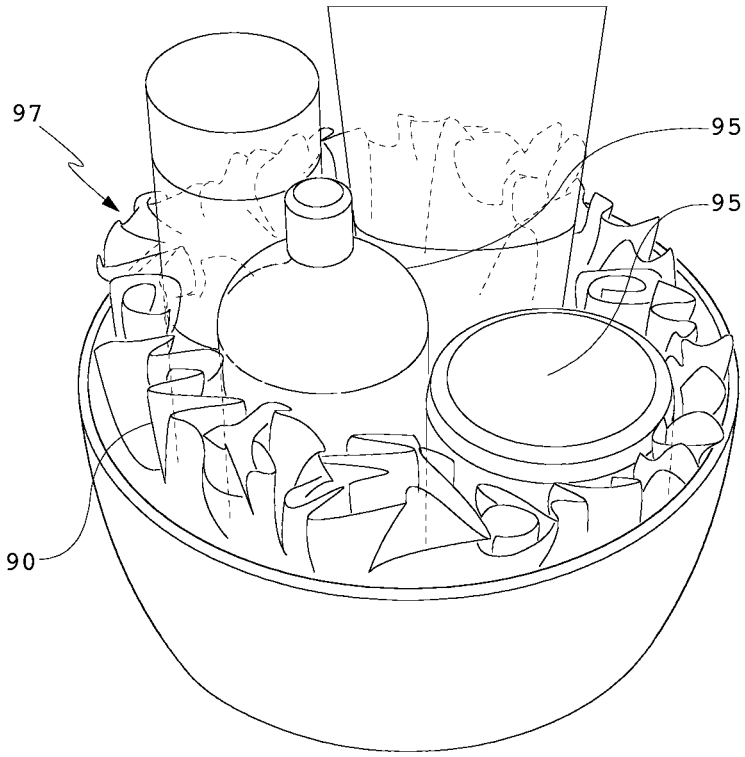
FIG. 10 is an illustration of the use of an exemplary device within a container packaging assembly where the device encircles the products.

FIG. 10 shows the use of an exemplary device 90 within a container packaging assembly 97. In this embodiment, the device 90 may encircle the various products 95. The container may be similar to the containers described for FIG. 9.

Using the device 90 in the embodiments shown in FIGS. 8-10 not only provides pleasing aesthetics, but also provides a means to secure the various products 95 included in the package and protect them from damage during shipping. Previously, disposable packaging materials may have been used for a similar purpose. Replacing the disposable packaging materials with a useful device can result in a more economic and environmentally-friendly packaging assembly. When used in these embodiments, the device may be fastened to form a complete ring or may alternatively be left unfastened. The device can provide structural stability to the packing assembly so that products may resist any shifting or changing of orientation during handling.

While certain embodiments are described in detail above, the scope of the invention is not to be considered limited by such disclosure, and modifications are possible without departing from the spirit of the invention as evidenced by the following claims:

What is claimed is:

1. An extendable applicator device comprising:

an elastomer having a relaxed length and a first and second end; and application material having a pre-attachment length which is substantially longer than the relaxed length of the elastomer and where the application material is surrounding the length of the elastomer and attached to the elastomer at the first and second ends so as to reduce the pre-attachment length of the application material down to substantially the same length as the relaxed length of the elastomer.

2. The extendable applicator device of claim 1 further comprising:

a first grip located near the first end of the elastomer; and a second grip located near the second end of the elastomer.

3. The extendable applicator device of claim 2 further comprising:

a fastening means near the first and second ends of the elastomer which fastens to form the elastomer into a ring.

4. The extendable applicator device of claim 3 wherein:

the fastening means comprises a loop on the first end of the elastomer and a knot on the second end of the elastomer.

5. The extendable applicator device of claim 2 wherein:

the first and second grips comprise a loop of the elastomer.

6. The extendable applicator device of claim 1 wherein:

the application material is open cell mesh material.

7. The extendable applicator device of claim 1 wherein:

the application material is cloth.

8. An extendable applicator device comprising:

a tubular piece of application material having a first opening, second opening, and hollow center with a central axis;

an elongate member traversing the hollow center of the application material, said member having a first end and second end where the second end is fastened to the second opening of the application material; and a spring-loaded retracting assembly attached near the first end of the elongate member such that retraction of the elongate member into the spring-loaded retracting assembly causes the tubular piece of application material to compress along its central axis.

9. The extendable applicator device of claim 8 further comprising:

a first grip attached to the second end of the elongate member.

10. The extendable applicator device of claim 8 further comprising:

a second grip attached to the retracting assembly.

11. The extendable applicator device of claim 8 wherein:

the application material is open cell mesh.

12. The extendable applicator device of claim 8 wherein:

the application material is cloth.

* * * * *